US007985304B2

(12) United States Patent
Cao et al.

(10) Patent No.: US 7,985,304 B2
(45) Date of Patent: Jul. 26, 2011

(54) NICKEL-BASE ALLOYS AND ARTICLES MADE THEREFROM

(75) Inventors: Wei-Di Cao, Charlotte, NC (US); Richard L. Kennedy, Monroe, NC (US); Michael M. Antony, Monroe, NC (US); John W. Smythe, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 811 days.

(21) Appl. No.: 11/737,361

(22) Filed: Apr. 19, 2007

(65) Prior Publication Data

US 2008/0257457 A1 Oct. 23, 2008

(51) Int. Cl.
*C22C 19/05* (2006.01)

(52) U.S. Cl. ..... 148/428; 420/448; 420/453

(58) Field of Classification Search ..... 420/448, 420/449, 450, 452, 453, 580–586.1; 148/428
See application file for complete search history.

(56) References Cited

U.S. PATENT DOCUMENTS

| | | | | |
|---|---|---|---|---|
| 3,705,827 | A * | 12/1972 | Muzyka | 148/607 |
| 3,772,005 | A | 11/1973 | deBarbadillo, II | |
| 3,785,877 | A * | 1/1974 | Bailey | 148/556 |
| 4,012,227 | A | 3/1977 | Forbes Jones et al. | |
| 4,014,680 | A | 3/1977 | Reen | |
| 4,040,876 | A | 8/1977 | Bleiberg et al. | |
| 4,041,274 | A | 8/1977 | Sadowski | |
| 4,086,085 | A | 4/1978 | McGurty | |
| 4,173,471 | A | 11/1979 | Mal et al. | |
| 4,248,629 | A | 2/1981 | Pons et al. | |
| 4,489,040 | A | 12/1984 | Asphahani et al. | |
| 4,505,232 | A | 3/1985 | Usami et al. | |
| 4,530,720 | A | 7/1985 | Moroishi et al. | |
| 4,560,408 | A | 12/1985 | Wilhelmsson | |
| 4,657,066 | A | 4/1987 | Whiddon et al. | |
| 4,671,929 | A | 6/1987 | Kajimura et al. | |
| 4,675,156 | A | 6/1987 | Sakamoto et al. | |
| 4,765,956 | A | 8/1988 | Smith et al. | |
| 4,765,957 | A | 8/1988 | Culling | |
| 4,784,831 | A | 11/1988 | Mankins et al. | |
| 4,824,638 | A | 4/1989 | Culling | |

(Continued)

FOREIGN PATENT DOCUMENTS

CH 650026 A5 6/1985

(Continued)

OTHER PUBLICATIONS

English translation of Isobe et al. JP 60-200936, published Oct. 1985, 11 pages.*

(Continued)

*Primary Examiner* — George Wyszomierski
*Assistant Examiner* — Mark L Shevin
(74) *Attorney, Agent, or Firm* — K & L Gates LLP; Patrick J. Viccaro; John E. Grosselin, III

(57) ABSTRACT

A nickel-base alloy having favorable toughness and thermal fatigue resistance comprises, in weight percentages based on total alloy weight: 9 to 20 chromium; 25 to 35 iron; 1 to 3 molybdenum; 3.0 to 5.5 niobium; 0.2 to 2.0 aluminum; 0.3 to 3.0 titanium; less than 0.10 carbon; no more than 0.01 boron; nickel; and incidental impurities. Also disclosed are die casting dies, other tooling, and other articles of manufacture made from or comprising the nickel-base alloy.

25 Claims, 11 Drawing Sheets

U.S. PATENT DOCUMENTS

| | | | | |
|---|---|---|---|---|
| 4,842,823 | A | 6/1989 | Sawaragi et al. | |
| 4,853,185 | A | 8/1989 | Rothman et al. | |
| 4,861,547 | A | 8/1989 | Culling | |
| 4,981,647 | A | 1/1991 | Rothman et al. | |
| 5,011,659 | A | 4/1991 | Culling | |
| 5,021,215 | A | 6/1991 | Sawaragi et al. | |
| 5,077,006 | A | 12/1991 | Culling | |
| 5,160,389 | A | 11/1992 | Akiyama et al. | |
| 5,306,358 | A * | 4/1994 | Lai et al. | 148/427 |
| 5,449,489 | A | 9/1995 | Gettliffe et al. | |
| 5,480,609 | A | 1/1996 | Dupoiron et al. | |
| 5,569,334 | A | 10/1996 | Kawata et al. | |
| 5,620,805 | A | 4/1997 | Ogawa et al. | |
| 5,827,377 | A | 10/1998 | Crum et al. | |
| 6,060,180 | A | 5/2000 | Ishitsuka et al. | |
| 6,352,670 | B1 | 3/2002 | Rakowski | |
| 6,409,847 | B2 | 6/2002 | Kleemann | |
| 6,531,002 | B1 * | 3/2003 | Henry et al. | 148/409 |
| 6,605,164 | B2 * | 8/2003 | Kennedy et al. | 148/410 |
| 2004/0156737 | A1 | 8/2004 | Rakowski | |

FOREIGN PATENT DOCUMENTS

| | | | |
|---|---|---|---|
| EP | 0709479 | A1 | 5/1996 |
| EP | 0866145 | B1 | 9/1998 |
| GB | 531466 | A | 1/1941 |
| GB | 638007 | A | 5/1950 |
| GB | 741558 | A | 12/1955 |
| GB | 993613 | A | 6/1965 |
| GB | 1332061 | A | 10/1973 |
| GB | 1508205 | | 4/1978 |
| GB | 2117792 | A | 10/1983 |
| GB | 2138446 | A | 10/1984 |
| GB | 2236113 | A | 3/1991 |
| JP | 49-102511 | | 9/1974 |
| JP | 60-59043 | A | 4/1985 |
| JP | 60-200936 | * | 10/1985 |
| JP | S60-224763 | A | 11/1985 |
| JP | 61-565 | A | 1/1986 |
| JP | 61-99661 | A | 5/1986 |
| JP | S62-20856 | A | 1/1987 |
| JP | 63-145751 | A | 6/1988 |
| JP | 5-70898 | A | 3/1993 |
| JP | 6-65692 | A | 3/1994 |
| JP | 9-291343 | A | 11/1997 |
| JP | 10-219402 | A | 8/1998 |
| JP | 10-237574 | A | 9/1998 |
| JP | 2000-1754 | A | 1/2000 |
| JP | 2000-144334 | A | 5/2000 |
| JP | 2000-192205 | A | 7/2000 |
| JP | 2002-309352 | A | 10/2002 |
| SU | 351922 | | 9/1972 |
| SU | 558964 | A | 5/1977 |
| WO | WO 02/14570 | A | 2/2002 |

OTHER PUBLICATIONS

Alloy Digest, DIEVAR™ (Hot-Work Tool Steel), Feb. 2002, ASM International, 2 pages.

Antony et al., "Thermal Fatigue Resistance of Alloy 718 for Aluminum Die Casting Dies," Superalloys 718, 625, 706 and Various Derivatives, Edited by E.A. Loria, The Minerals, Metals & Materials Society, 2001, pp. 657-667.

Davis, J.R., "Heat-Resistant Materials," 1997, p. 126.

Davis, J.R., "Nickel, Cobalt and Their Alloys," 2000, p. 33.

English translation of claim 1 of Japanese Unexamined Patent Publication SHO.61-99661, Published May 17, 1986.

English translation of claims 1-5 of Japanese Unexamined Patent Publication 2000-192205, Published Jul. 11, 2000.

English translation of claims 1-8 of Japanese Unexamined Patent Publication 2000-1754, Published Jan. 7, 2000.

Premium Quality H-13 Steel, Simalex, Custom Pressure Die Casting, printed from http://www.simalex.com/h13.htm on Oct. 30, 2007, 5 pages.

Technical Data Blue Sheet, Allegheny Ludlum Altemp® 625 Nickel-Base Superalloy (UNS Designation N06625), pp. 1-8, Published 1998.

Technical Data Blue Sheet, Allegheny Ludlum Altemp® 718 Alloy Nickel-Base Superalloy (UNS Designation N07718), pp. 1-4, Published 1998.

Technical Data Blue Sheet, Allegheny Ludlum Stainless Steel Type 332 (UNS N08800), pp. 1-6, Published 1999.

* cited by examiner

NICKEL-BASE ALLOYS AND ARTICLES MADE THEREFROM

BACKGROUND OF THE TECHNOLOGY

1. Field of Technology

The present disclosure relates to nickel-base alloys and articles of manufacture made therefrom. The present disclosure more particularly relates to nickel-base alloys having substantial thermal cracking resistance and other properties making the alloys suitable for use in die casting dies and in other articles of manufacture.

2. Description of the Background of the Technology

Die castings are produced by injecting molten metal under pressure into the cavity of a metal mold or die. (As used herein, "metal" refers to metals and metallic alloys.) The cavity imparts shape to the solidifying metal. There are four principal alloy systems that are commonly die cast. These include zinc, magnesium, aluminum, and copper (brass) alloy systems. The approximate casting temperatures for these systems are 800° F. (427° C.), 1200° F. (649° C.), 1250° F. (677° C.), and 1780° F. (971° C.), respectively. The performance of a casting die depends upon the material from which the die is made, the die heat treatment steps, and a number of non-material-related factors, including casting temperature, die geometry, and casting speed. In general, higher casting temperatures, greater die cavity complexity, and higher casting speeds degrade casting die performance. Casting dies fail predominantly by thermal fatigue or heat checking, where small cracks develop on the die surface after repeated thermal cycling. Stress corrosion cracking (SCC) and corrosion fatigue have also been identified as operative mechanisms of casting die failure and may significantly facilitate the development of thermal fatigue cracking. Therefore, high resistance to cracking, either due to thermal fatigue/thermal checking or other mechanisms, has been considered an important characteristic for high quality die alloys.

Casting dies are typically made of hot work tool steels. The most common die casting die alloy is H-13 steel (UNS T20813), which nominally includes, in weight percentages, 0.4 carbon, 5.25 chromium, 1.5 molybdenum, 1.0 vanadium, and balance iron. Maraging steels are also used, primarily for die components having relatively complex geometries that preclude the removal of the EDM recast layer. Other steel alloys used in die casting dies include mold steels and certain martensitic stainless steels.

Die casting dies are very expensive, and in some applications the die may cost more than the die casting machine itself. Therefore, die life is a major consideration in the die casting industry. Die life is typically measured in "shots" or number of parts, and 20,000 to over 200,000 parts per die is considered a typical die service lifetime. Thermal cracking is generally regarded as the most significant failure mode that limits die life. The steel alloys widely used in making die casting dies, however, have relatively limited thermal cracking resistance, requiring rather frequent replacement of the dies. Thus, developing a material having comparable mechanical properties and exhibiting significantly better thermal cracking resistance than conventional steel die casting alloys has been and continues to be a focus of research and development efforts.

Accordingly, it would be advantageous to provide an improved alloy having good mechanical properties and substantial resistance to thermal cracking, and that would be suitable for use in die casting die applications. It also would be advantageous to provide die casting dies and other tooling fabricated from such alloys.

SUMMARY

According to one non-limiting aspect of the present disclosure, nickel-base alloys are provided having substantial thermal cracking resistance and comprising, in weight percentages based on total alloy weight: 9 to 20 chromium; 25 to 35 iron; 1 to 3 molybdenum; 3.0 to 5.5 niobium; 0.2 to 2.0 aluminum; 0.3 to 3.0 titanium; less than 0.10 carbon; no more than 0.01 boron; nickel; and incidental impurities. The alloys have strength and toughness properties making them suitable for use in, for example, die casting die applications.

According to another non-limiting aspect of the present disclosure, nickel-base alloys are provided having substantial thermal cracking resistance and consisting essentially of, in weight percentages based on total alloy weight: 9 to 20 chromium; 25 to 35 iron; 1 to 3 molybdenum; 3.0 to 5.5 niobium; 0.2 to 2.0 aluminum; 0.3 to 3.0 titanium; no more than 0.10 carbon; less than 0.01 boron; optionally, trace elements; incidental impurities; and nickel.

According to yet another non-limiting aspect of the present disclosure, nickel-base alloys are provided having substantial thermal cracking resistance and consisting of, in weight percentages based on total alloy weight: 9 to 20 chromium; 25 to 35 iron; 1 to 3 molybdenum; 3.0 to 5.5 niobium; 0.2 to 2.0 aluminum; 0.3 to 3.0 titanium; less than 0.10 carbon; no more than 0.01 boron; optionally, trace elements; incidental impurities; and balance nickel.

Certain non-limiting embodiments of the nickel-base alloys according to the present disclosure also include one or more of the following: a combined level of chromium and nickel that is at least 44 weight percent; no more than 30 weight percent iron; a combined level of aluminum and titanium greater than 3.0 atomic percent; and an aluminum/titanium weight percentage ratio greater than 1.0, and more preferably greater than 2.0.

Certain other non-limiting aspects of the present disclosure are directed to die casting dies, other tooling, and other articles of manufacture made from or comprising any of the alloys according to the present disclosure.

BRIEF DESCRIPTION OF THE DRAWINGS

Features and advantages of the apparatus and methods described herein may be better understood by reference to the accompanying drawings in which:

FIG. 2(*b*) is a photomicrograph of the microstructure of an alloy according to the present disclosure including a combined level of iron and chromium greater than 44 weight percent and including a significant concentration of Laves phase particles;

FIG. 5(*b*) is a photomicrograph of the microstructure of an alloy according to the present disclosure having a relatively low aluminum/titanium atomic ratio and including a significant concentration of undesirable Laves phase particles.

Figure 1:
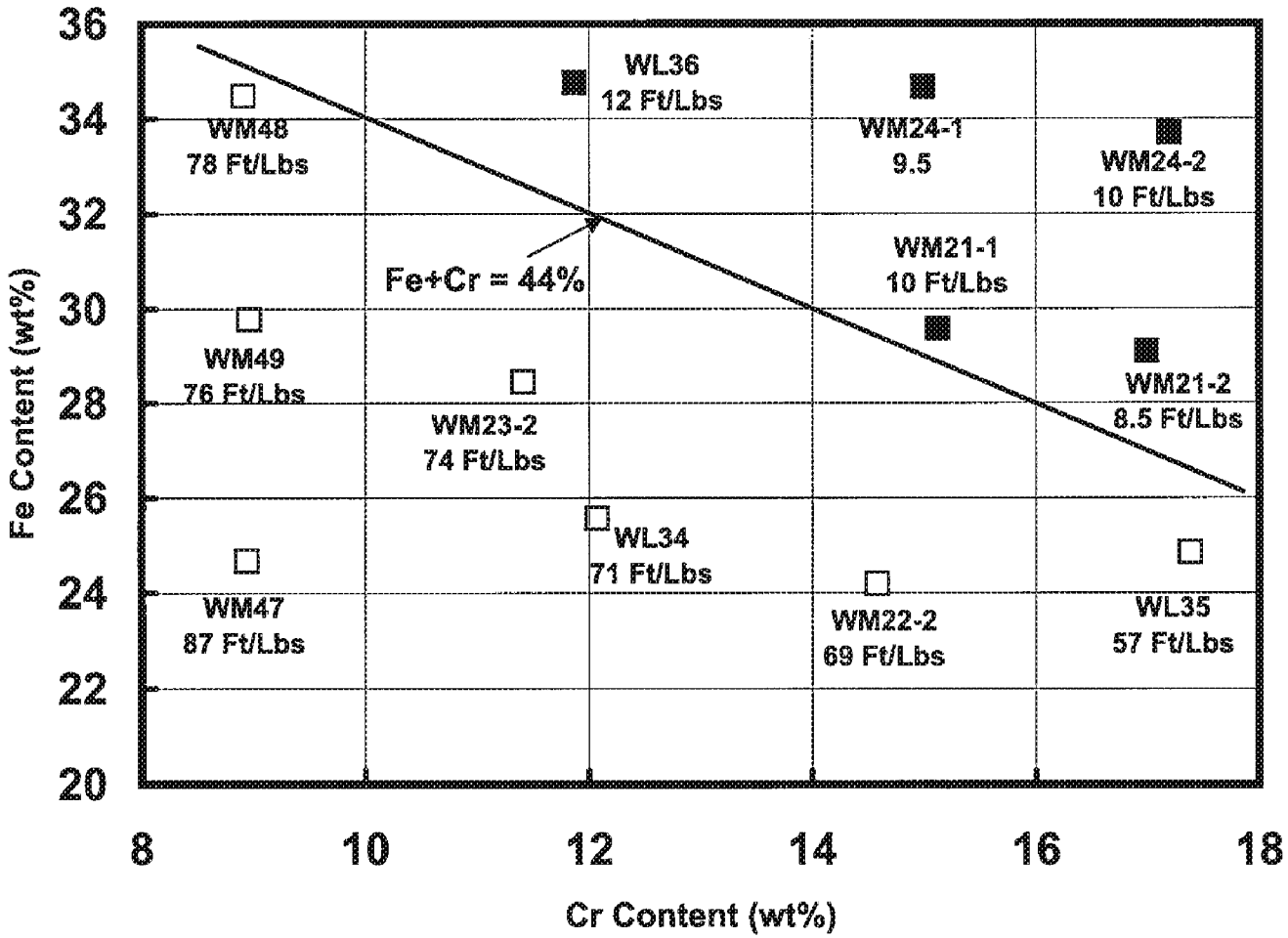
FIG. 1 is a plot illustrating the effect of iron and chromium concentration on mechanical properties and microstructure of several alloys according to the present disclosure, wherein solid squares indicate alloys including a significant concentration of undesirable Laves phase particles and open squares indicate alloys lacking noticeable Laves phase particles.

The reader will appreciate the foregoing details, as well as others, upon considering the following detailed description of certain non-limiting embodiments of alloys, articles, and methods according to the present disclosure. The reader also may comprehend certain of such additional details upon carrying out or using the alloys, articles, and methods described herein.

DETAILED DESCRIPTION OF CERTAIN NON-LIMITING EMBODIMENTS

In the present description of non-limiting embodiments and in the claims, other than in the operating examples or where otherwise indicated, all numbers expressing quantities or characteristics of ingredients and products, processing conditions, and the like are to be understood as being modified in all instances by the term "about". Accordingly, unless indicated to the contrary, any numerical parameters set forth in the following description and the attached claims are approximations that may vary depending upon the desired properties one seeks to obtain in the alloys, articles of manufacture, and methods according to the present disclosure. At the very least, and not as an attempt to limit the application of the doctrine of equivalents to the scope of the claims, each numerical parameter should at least be construed in light of the number of reported significant digits and by applying ordinary rounding techniques.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

The present disclosure, in part, is directed to an improved nickel-base alloy having significant resistance to thermal cracking and certain other properties making it suitable for use in die casting dies, other tooling, and in various other articles of manufacture. As noted above, thermal cracking resistance is an important characteristic of alloys used in die casting die applications. One of the important factors contributing to thermal cracking failure in conventional steel die casting die alloys is the alloys' relatively low thermal stability in that the alloys suffer loss of strength and hardness with prolonged exposure to the high temperatures typical for normal operating conditions. It is generally believed that thermal cracking of die casting dies is caused primarily by thermal fatigue, which is a special type of strain-controlled, low cycle fatigue. The driving force for thermal fatigue of die alloys is the plastic strain amplitude caused by thermal cycling as the die is repeatedly heated to high temperature and then cools. Generally, the greater the magnitude of the plastic strain amplitude, the more likely is the occurrence of thermal cracking, and the faster the thermal crack growth.

The interaction between plastic strain amplitude and die casting die material properties can be described mathematically. The plastic strain amplitude can be expressed as:

$$\Delta\epsilon^p=\Delta\epsilon^t-\Delta\epsilon^e,$$

wherein $\Delta\epsilon^p$ is the plastic strain amplitude caused by thermal cycling, and $\Delta\epsilon^t$ and $\Delta\epsilon^e$ are the total strain and elastic strain amplitudes due to thermal cycling, respectively. As the first approximation, $\Delta\epsilon^t$ can be regarded as the product of the thermal expansion coefficient $\alpha$ of the die material and the die temperature difference $\Delta T$ experienced during thermal cycling, and $\Delta\epsilon^e$ is determined by the elastic limit strength $\sigma_e$ and the elastic modulus E of the die material for a specific application. The plastic strain amplitude can be approximated as:

$$\Delta\epsilon^p=\Delta\epsilon^t-\Delta\epsilon^e=\alpha\Delta T-\sigma_e/E,$$

wherein $\Delta T$ is basically determined by the working condition for a well-designed die and, to a lesser degree, by the thermal conductivity of the die material.

It is generally believed that reducing the driving force of thermal cracking in alloys used for making die casting dies requires an alloy having a low coefficient of thermal expansion, high thermal conductivity, low elastic modulus, and high elastic limit strength. For most steel die alloys, the differences in thermal expansion coefficient, thermal conductivity, and elastic modulus are minimal and, therefore, the driving force for thermal cracking in those dies would be determined mainly by the elastic limit of the alloy at constant working conditions. In other words, in steel dies alloys, the higher the elastic limit (which can be roughly treated as proportional to yield strength), the lower is the driving force for thermal cracking.

Steel alloys can be produced with very high elastic limits or yield strengths in the as-heat treated state, but strength rapidly deteriorates when the alloys are subjected to conditions such as those in which die casting dies may operate. The surface temperature of dies used in magnesium and aluminum die casting, for example, can reach 1150° F. to 1200° F. (621° C. to 649° C.). At such high temperatures, most die steel alloys rapidly soften, and their elastic limit or yield strength may drop to nearly half the initial value. Consequently, the plastic strain amplitude applied to the die surface (the driving force of thermal fatigue cracking) will significantly increase with time, which greatly contributes to thermal cracking. In addition to the driving force for thermal cracking, the thermal cracking resistance of a die casting die alloy also has a significant influence on the occurrence of thermal cracking. Thus, an alloy with high thermal cracking resistance generally will have longer service life as a die casting die under the same driving force. Also, it has been shown that thermal fatigue is low cycle fatigue and, therefore, the toughness of an alloy may also significantly affect its thermal fatigue resistance. Alloys having higher toughness will have higher resistance to thermal cracking under the same driving force (plastic strain amplitude). Therefore, it is desirable that a die casting die alloy exhibit not only high strength and high thermal stability, but also significant toughness.

As noted above, stress corrosion cracking (SCC) and/or corrosion fatigue may become a failure mode for die casting die alloys. For example, a crack could initiate by an SCC mechanism, or at pits generated by corrosion or a fatigue mechanism. Crack growth could also be assisted by SCC or corrosion from die lubricants. Therefore, high resistance to corrosion, corrosion fatigue, and SCC also are considered important in the design of die casting die alloys.

Considering the desired properties discussed above, it has been proposed that certain nickel-base superalloys, including Alloy 718 (UNS N07718), are good candidates for die casting dies due to the alloys' high strength, high thermal stability, favorable toughness, and high corrosion/SCC resistance. However, nickel-base superalloys like Alloy 718 have never received serious consideration as die materials, although some successful applications have been reported. Major disadvantages of nickel-base superalloys are high raw material costs and poor machinability. Poor machinability is especially detrimental given that a large portion of the total cost of dies is the machining cost.

In considering possible alternative alloys for die casting die applications, the present inventors considered the following properties desirable:

- Low thermal expansion coefficient and high thermal conductivity.
- High strength, preferably approaching or better than that of H13 alloy at die casting die operating temperatures.
- High thermal stability, preferably approaching or better than that of Alloy 718 at die casting die operating temperatures.
- High toughness, preferably better than that of H13 alloy, and more preferably better than that of Alloy 718.
- High thermal cracking resistance, preferably better than that of H13 alloy, and more preferably better than that of Alloy 718.
- High corrosion/SCC resistance, preferably better than that of H13 alloy.
- Good machinability, preferably better than that of Alloy 718.
- Relatively simple heat treatment regimen, preferably in air.
- Relatively low total cost of die fabrication, including material costs and processing (machining and heat treatment) costs.

With the above desirable properties in mind, the present disclosure provides novel nickel-base alloys having high strength, substantial toughness, high thermal stability, and favorable thermal cracking resistance. It is believed that the alloys would be particularly well suited for die casting die applications and other applications demanding similar performance. As discussed below, certain embodiments of the alloys exhibit toughness and thermal fatigue crack resistance at least comparable to H-13 alloy, as well as improved machinability and lower cost compared with Alloy 718.

According to certain non-limiting embodiments, alloys according to the present disclosure may be predominantly γ' strengthened and include aluminum, titanium, and niobium as major strengthening elements, preferably along with a high combined concentration of aluminum+titanium and/or a high aluminum/titanium weight ratio, to promote the formation of predominantly γ' precipitates with high thermal stability and avoid the formation of detrimental phases. Preferably, in such non-limiting embodiments niobium addition is controlled to the lowest level providing the desired alloy characteristics in order to reduce alloy cost without significantly adversely affecting desired alloy properties. Substantial iron was included in the alloy to improve machinability and reduce alloy cost. Chromium content was adjusted to provide sufficient oxidation/corrosion resistance, while at the same time inhibiting formation of detrimental phases in the alloy.

According to one embodiment, nickel-base alloys according to the present disclosure comprise, in weight percentages based on total alloy weight: 9 to 20 chromium; 25 to 35 iron; 1 to 3 molybdenum; 3.0 to 5.5 niobium; 0.2 to 2.0 aluminum; 0.3 to 3.0 titanium; less than 0.10 carbon; no more than 0.01 boron; nickel; and incidental impurities. (Unless otherwise noted herein, all alloy weight percentages are based on total alloy weight.)

According to another embodiment, nickel-base alloys according to the present disclosure consist essentially of: 9 to 20 chromium; 25 to 35 iron; 1 to 3 molybdenum; 3.0 to 5.5 niobium; 0.2 to 2.0 aluminum; 0.3 to 3.0 titanium; less than 0.10 carbon; no more than 0.01 boron; nickel; optionally, trace elements; and incidental impurities.

According to yet another non-limiting embodiment, the nickel-base alloy of the present disclosure consists of: 9 to 20 chromium; 25 to 35 iron; 1 to 3 molybdenum; 3.0 to 5.5 niobium; 0.2 to 2.0 aluminum; 0.3 to 3.0 titanium; less than 0.10 carbon; no more than 0.01 boron; optionally, trace elements; incidental impurities; and balance nickel.

As used herein, "trace elements" refers to elements that may present in the alloy as a result of the composition of the raw materials and/or the melt method employed and which are not present in concentrations that negatively affect the desirable properties of the alloy, as those properties are generally described herein, in a significant way. Trace elements may include, for example, any of the following up to the following maximum concentrations, in weight percentages: 0.25 silicon; 1.00 manganese; 1.00 tungsten; 3.00 cobalt; 0.50 tantalum; 0.20 zirconium; and 0.50 copper. As indicated in the paragraphs above, which refer to trace elements as optional, trace elements may or may not be present in alloys according to the present disclosure. As is known in the art, in producing alloys trace elements typically can be largely or wholly eliminated by selection of particular starting materials and use of particular processing techniques. Non-limiting examples of "incidental impurities", as that term is used herein, include sulfur, phosphorus, silver, selenium, bismuth, lead, tellurium, and titanium. Preferably, the individual concentrations of these particular incidental impurities do not exceed the following weight percentages: 0.025 sulfur; 0.025 phosphorus; and 0.0005 for each of silver, selenium, bismuth, lead, tellurium, and thallium. Other elements that may be present as trace elements or incidental impurities in alloys of the type described herein will be apparent to those having ordinary skill in the art. In one preferred embodiment of an alloy according to the present disclosure, the total concentration of trace elements does not exceed 5 weight percent, based on the total weight of the alloy. In another preferred embodiment of an alloy according to the present disclosure, the total combined concentration of trace elements and incidental impurities does not exceed 5 weight percent, based on the total weight of the alloy.

According to a further non-limiting embodiment, a nickel-base alloy according to the present disclosure comprises: 9 to 20 weight percent chromium; 25 to 30 weight percent iron; chromium+iron≦44 weight percent; 1.5 to 2.5 weight percent molybdenum; 4 to 5 weight percent niobium; 1.0 to 1.8 weight percent aluminum; 0.4 to 1.0 weight percent titanium; aluminum+titanium≧1 weight percent; 1.5≦aluminum/titanium≦3 (weight percentage ratio); less than 0.10 weight percent carbon; no more than 0.005 weight percent boron; nickel; and incidental impurities.

According to an additional non-limiting embodiment, a nickel-base alloy according to the present disclosure consists essentially of: 9 to 20 weight percent chromium; 25 to 30 weight percent iron; chromium+iron≦44 weight percent; 1.5 to 2.5 weight percent molybdenum; 4 to 5 weight percent niobium; 1.0 to 1.8 weight percent aluminum; 0.4 to 1.0 weight percent titanium; aluminum+titanium≧1 weight percent; 1.5≦aluminum/titanium≦3 (weight percentage ratio); less than 0.10 weight percent carbon; no more than 0.005 weight percent boron; optionally, trace elements; incidental impurities; and nickel.

According to yet an another non-limiting embodiment, a nickel-base alloy according to the present disclosure consists of: 9 to 20 weight percent chromium; 25 to 30 weight percent iron; chromium+iron≦44 weight percent; 1.5 to 2.5 weight percent molybdenum; 4 to 5 weight percent niobium; 1.0 to 1.8 weight percent aluminum; 0.4 to 1.0 weight percent titanium; aluminum+titanium≧1 weight percent; 1.5≦aluminum/titanium≦3 (weight percentage ratio); less than 0.10 weight percent carbon; no more than 0.005 weight percent boron; nickel; optionally, trace elements, incidental impurities, and balance nickel.

Nickel-base alloys according to the present disclosure were formulated, at least in part, based on the results of the following investigations conducted by the inventors.

It was determined that the content of chromium and iron in the alloys may be selected to provide advantageous mechanical properties, high corrosion resistance, and relatively low alloy cost. Low chromium levels should provide a relatively low thermal expansion coefficient, which is beneficial for die casting die applications, but which also reduces corrosion resistance and increases cost (as the alloy will include more of the relatively costly nickel). Higher chromium levels should promote the formation of harmful topologically closed packed (TCP) phases, such as sigma and/or Laves phases, and would also deteriorate hot workability and mechanical properties. High iron levels are desirable from an alloy cost standpoint, but excessive iron also will promote formation of detrimental TCP phases, leading to significant degradation of mechanical properties and ease of processing. The effect of adjusting alloy chromium and iron levels was investigated by preparing and evaluating the series of experimental alloys listed in Table 1. All the alloys listed in Table 1 had substantially the same chemistry, with the exception of chromium and iron contents.

TABLE 1

| | Chemistry (weight percentages) | | | | | | | | | | | | | | | |
|---|---|---|---|---|---|---|---|---|---|---|---|---|---|---|---|---|
| Heat | C | Cr | Mo | W | Ni | Co | Fe | Mn | Si | Nb | Ta | Al | Ti | S | P | B |
| WM47 | 0.006 | 8.94 | 2.00 | <.01 | Bal. | <.01 | 24.67 | <.01 | <.01 | 4.46 | <.01 | 1.45 | 0.64 | <.0003 | <.003 | 0.0035 |
| WL34 | 0.012 | 12.07 | 2.02 | <.01 | Bal. | 0.11 | 25.57 | <.01 | <.01 | 4.46 | <.01 | 1.45 | 0.68 | <.0003 | <.003 | 0.004 |
| WM22-2 | 0.010 | 14.58 | 1.95 | <.01 | Bal. | 0.02 | 24.19 | <.01 | <.01 | 4.37 | <.01 | 1.39 | 0.63 | .0003 | <.003 | 0.0041 |
| WL35 | 0.009 | 17.38 | 2.00 | <.01 | Bal. | <.01 | 24.85 | <.01 | <.01 | 4.39 | <.01 | 1.43 | 0.64 | <.0003 | <.003 | 0.004 |
| WM49 | 0.008 | 8.96 | 2.01 | <.01 | Bal. | <.01 | 29.78 | <.01 | <.01 | 4.46 | <.01 | 1.43 | 0.65 | .0004 | <.003 | 0.004 |
| WM23-2 | 0.008 | 11.41 | 1.92 | <.01 | Bal. | <.01 | 28.46 | <.01 | <.01 | 4.28 | <.01 | 1.37 | 0.61 | <.0003 | <.003 | 0.0043 |
| WM21-1 | 0.010 | 15.12 | 2.55 | <.01 | Bal. | 0.15 | 29.58 | .012 | .014 | 4.26 | <.01 | 1.65 | 0.78 | .0005 | <.003 | 0.004 |
| WM21-2 | 0.010 | 16.99 | 2.49 | <.01 | Bal. | 0.15 | 29.10 | .012 | .012 | 4.11 | <.01 | 1.61 | 0.76 | .0004 | <.003 | 0.0037 |
| WM48 | 0.006 | 8.91 | 1.98 | <.01 | Bal. | <.01 | 34.49 | <.01 | <.01 | 4.37 | <.01 | 1.44 | 0.63 | .0004 | <.003 | 0.004 |
| WL36 | 0.006 | 11.87 | 2.01 | <.01 | Bal. | <.01 | 34.77 | <.01 | <.01 | 4.38 | <.01 | 1.42 | 0.63 | .0004 | <.003 | 0.004 |
| WM24-1 | 0.010 | 14.99 | 2.00 | <.01 | Bal. | <.01 | 34.68 | <.01 | <.01 | 4.49 | <.01 | 1.43 | 0.70 | <.0003 | <.003 | 0.0049 |
| WM24-2 | 0.008 | 17.19 | 1.95 | <.01 | Bal. | <.01 | 33.70 | <.01 | <.01 | 4.42 | <.01 | 1.38 | 0.69 | <.0003 | <.003 | 0.0048 |

Each alloy listed in Table 1 was made by vacuum induction melting (VIM), followed by vacuum arc re-melting (VAR). The VAR ingots were homogenized, press-forged and hot rolled into ⅝-inch round bars. Test sample blanks were cut from the rolled bars and tested after being subjected to the following solution age heat treatment, which is conventionally applied to Alloy 718: hold at 1750° F. (954° C.) for 1 hour time-at-temperature; air cool to room temperature; hold at 1325° F. (718° C.) for 8 hours time-at-temperature; furnace cool at 50° F./hr (27.7° C./hr) to 1150° F. (621° C.); hold at 1150° F. (621° C.) for 8 hours time-at-temperature; and air cool to room temperature. Mechanical properties of the alloys in Table 1 are listed in Table 2.

TABLE 2

| | Chemistry (wt. %) | | RT Tensile | | | | 1000° F. (538° C.) Tensile Properties | | | | |
|---|---|---|---|---|---|---|---|---|---|---|---|
| Heat | Fe | Cr | UTS (ksi) | YS (ksi) | EL (%) | RA (%) | UTS (ksi) | YS (ksi) | EL (%) | RA (%) | Charpy (ft/lbs) |
| WM47 | 25 | 9 | 205.1 | 138.5 | 29.3 | 53.2 | 177.5 | 125.6 | 28.7 | 55.9 | 86.5 |
| WL34 | 25 | 12 | 202.5 | 136.8 | 29.0 | 54.7 | 173.5 | 121.4 | 27.2 | 56.2 | 71 |
| WM22-2 | 25 | 15 | 195.6 | 128.8 | 29.7 | 53.3 | 172.1 | 120.4 | 26.6 | 56.6 | 69 |
| WL35 | 25 | 18 | 197.6 | 127.9 | 30.3 | 54.4 | 169.4 | 116.3 | 27.5 | 54.7 | 57 |
| WM49 | 30 | 9 | 218.3 | 144.4 | 25.0 | 40.0 | 187.3 | 131.8 | 23.1 | 41.7 | 75.5 |
| WM23-2 | 30 | 12 | 193.5 | 126.4 | 29.9 | 54.5 | 168.3 | 116.9 | 27.9 | 57.5 | 74 |
| WM21-1 | 30 | 15 | 210.2 | 148.7 | 20.6 | 30.5 | 189.6 | 139.3 | 19.8 | 33.5 | 10 |
| WM21-2 | 30 | 18 | 210.0 | 156.6 | 19.7 | 28.2 | 192.8 | 146.2 | 18.8 | 35.0 | 8.5 |
| WM48 | 35 | 9 | 217.0 | 142.0 | 25.3 | 41.8 | 183.0 | 127.2 | 23.4 | 45.1 | 77.5 |
| WL36 | 35 | 12 | 215.2 | 156.6 | 21.4 | 39.1 | 189.2 | 139.9 | 20.0 | 43.1 | 12 |
| WM24-1 | 35 | 15 | 207.0 | 147.2 | 19.0 | 27.2 | 188.2 | 140.0 | 18.3 | 36.9 | 9.5 |
| WM24-2 | 35 | 18 | 204.1 | 144.0 | 19.5 | 27.4 | 183.5 | 135.2 | 18.3 | 36.7 | 10 |

Figure 2:
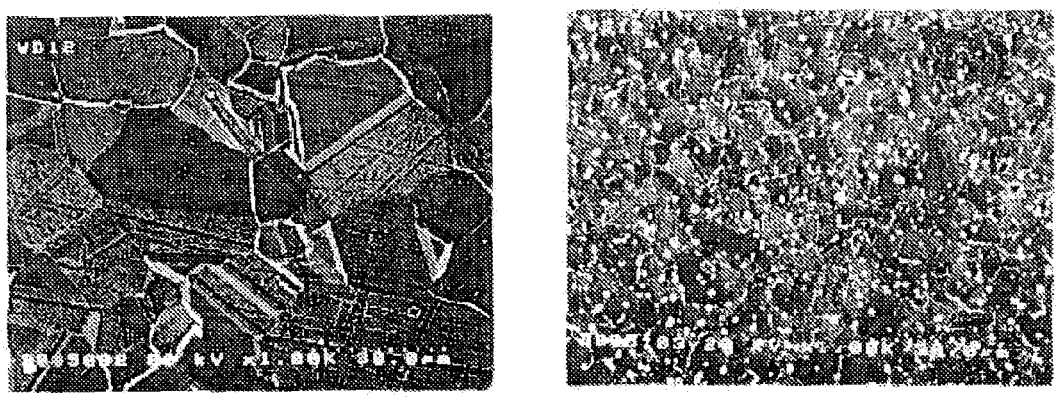
FIG. 2(*a*) is a photomicrograph of the microstructure of an alloy according to the present disclosure including a combined level of iron and chromium less than 44 weight percent and lacking noticeable Laves phase precipitation.

It was observed that the level of chromium and iron in the experimental alloys of Table 1 significantly affected alloy toughness. As the data in Table 2 shows, certain alloys including relatively high levels of iron and chromium had relatively low toughness. The correlation between toughness and iron and chromium contents is graphically illustrated in FIG. 1, which is a matrix of experimental alloy iron and chromium levels indicating the Charpy impact toughness of each alloy. The results plotted in FIG. 1 indicate that the sum of chromium and iron contents preferably should be no greater than about 44 weight percent to provide favorable toughness. The microstructures of the test samples were examined by scanning electron microscopy (SEM), and it was found that Laves phase existed in the experimental alloys having a combined level of chromium and iron greater than 44 weight percent. The experimental alloys including a significant amount of Laves phase particles are shown in FIG. 1 as solid squares. The experimental alloys lacking any significant Laves phase particles are shown as open squares in FIG. 1. FIG. 2(*a*) is a photomicrograph showing the microstructure of one of the experimental alloys having a combined level of chromium and iron less than 44 weight percent, and which lacked any appreciable Laves phase particles. In comparison, FIG. 2(*b*) is a photomicrograph showing the microstructure of one of the experimental alloys having a combined level of chromium and iron greater than 44 weight percent, and which included a significant amount of Laves phase particles. The presence of significant Laves phase precipitation is believed to be at least partially responsible for the significant deterioration in mechanical properties, such as Charpy impact toughness, in certain experimental alloys including a combined level of chromium and iron greater than 44 weight percent.

The relationship between chromium and iron content and thermal fatigue resistance for a number of the experimental alloys listed in Table 1 was investigated. The thermal fatigue testing was performed using specially designed equipment. Surface-ground alloy samples were prepared having a 0.5×0.5 inch cross-section and 7 inch length. Each sample was subjected to thousands of heating-cooling cycles, wherein each cycle consisted of heating the sample 7 seconds in a molten aluminum bath held at about 1300° F. (704° C.) and then quickly transferring the sample to a water tank at 68° F. (20° C.) and holding it there for 4 seconds. Each of the samples was subjected to 20,000 of such cycles and surface polished. The corners of each sample were examined for thermal fatigue cracking using an optical microscope. The total length of all cracks in a sample was determined, and crack length per unit length of sample was calculated and used as a measure of the alloy's resistance to thermal fatigue cracking. The greater the crack length per unit length of the sample, the poorer was the thermal fatigue resistance of the alloy. The results for the experimental alloys are shown in Table 3. Up to three test runs on different samples were performed for certain of the experimental alloys, and the average of the runs is shown in the last row of Table 3.

TABLE 3

| Test | Total Crack Length (Inch per Inch of Sample) | | | | | | | | | |
|---|---|---|---|---|---|---|---|---|---|---|
| Run | H13 | WL34 | WM22-2 | WM21-2 | WM24-1 | WM44 | WM45 | WM46 | WM48 | WP27-1 |
| 1 | 0.805 | 1.0713 | 0.220 | 0.243 | 0.571 | 0.0533 | 0.2367 | 0.014 | 0.6707 | 0.005 |
| 2 | — | 0.1628 | — | — | — | 0.3282 | — | — | 0.506 | 0.0096 |
| 3 | — | 0.107 | — | — | — | — | — | — | — | 0.417 |
| Final | 0.805 | 0.135 | 0.220 | 0.243 | 0.571 | 0.191 | 0.237 | 0.014 | 0.591 | 0.0073 |

Figure 3:
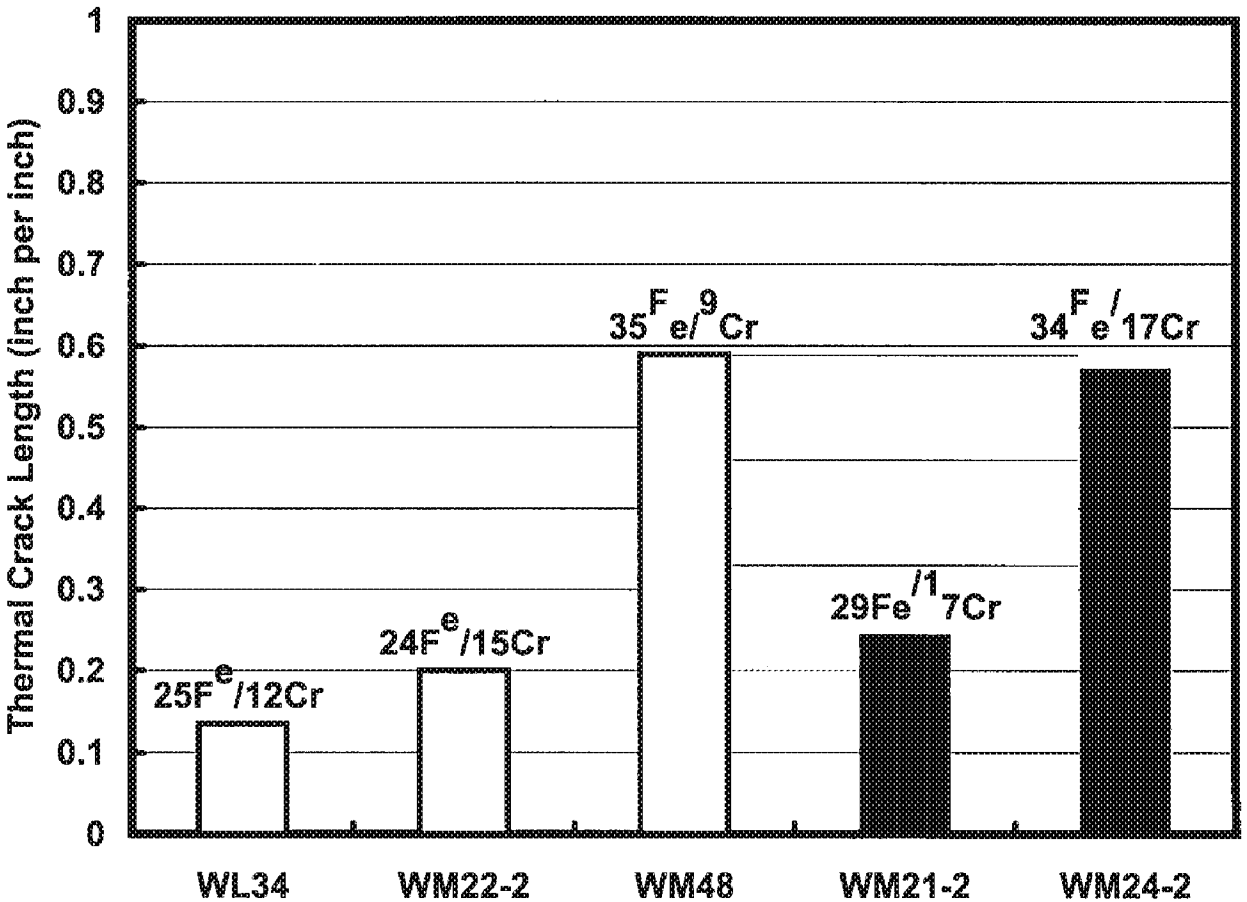
FIG. 3 is a plot of thermal fatigue cracking resistance of several alloys according to the present disclosure having varying iron and chromium contents, wherein solid bars indicate alloys including a significant concentration of Laves phase particles and open bars indicate alloys lacking noticeable Laves phase particles.

FIG. 3 illustrates the thermal fatigue cracking test results for experimental alloys having different combined levels of chromium and iron. Solid bars indicate alloys having a combined level of chromium and iron greater than 44 weight percent, and hollow bars indicate alloys having a combined level of chromium and iron equal to or less than 44 weight percent. Considering FIGS. 1 and 3, it appears that thermal fatigue resistance of the experimental alloys may not be directly dependent on toughness or the presence or absence of Laves phase particles. For example, certain of the experimental alloys exhibiting high Charpy impact toughness and lacking Laves phase precipitation also exhibited relatively low thermal fatigue resistance. The results shown in Table 3 and FIG. 3, however, do suggest that the iron content of the alloy has a significant effect on thermal cracking resistance. It appears that, in general, the higher the alloy iron content, the lower the thermal fatigue resistance, as evaluated by the foregoing experimental test procedure. The results further suggest that high chromium content also may have a detrimental effect on thermal fatigue resistance of the experimental alloys, but to a lesser degree than seen with variation in iron content.

Based on the foregoing testing, the inventors believe that relatively low chromium and iron contents are preferable in alloys according to the present disclosure for purposes of improving Charpy impact toughness and thermal fatigue resistance. With regard to the experimental alloys, it is preferred that iron levels are no greater than 30 weight percent and combined chromium and iron levels are no greater than 44 weight percent so as to provide a favorable combination of alloy strength, toughness and thermal fatigue resistance.

Experimentation also indicated that controlling the aluminum level, titanium level, and the aluminum/titanium weight ratio of alloys according to the present disclosure can provide improved alloy properties. In niobium-containing nickel-base alloys, such as Alloy 718 and the experimental alloy embodiments considered herein, the nature of precipitation-hardening phases is influenced by the relative levels of niobium, aluminum, and titanium. For a constant niobium concentration in such an alloy, the predominant precipitate transitions from γ' to γ' as levels of aluminum and titanium are increased. It is known that alloys strengthened by γ' particles have higher thermal stability than alloys including γ' particles as the strengthening phase. As stated above, high thermal stability is very important in die casting die alloys. To ensure a predominantly γ' phase strengthening mechanism in an alloy having a niobium level of about 4.5 weight percent, the inventors' calculations indicate that the combined atomic percentage of aluminum and titanium preferably is greater than 3.0 atomic percent (this atomic percentage is equivalent to about 1.5 to about 2.5 weight percent, depending on the aluminum/titanium ratio in the alloy). Therefore, it is preferred that nickel-base alloys according to the present disclosure include a combined concentration of aluminum and titanium of at least 1 weight percent and, more preferably, greater than 3.0 atomic percent.

In order to optimize thermal stability of alloys according to the present disclosure, the present inventors conducted experiments to investigate how the alloys' aluminum and titanium contents may be adjusted to stabilize the mechanism of alloy strengthening by precipitation of γ' phase. As discussed further below, the results of these experiments indicate that the γ' strengthening phase is more stable in alloys having a higher aluminum/titanium ratio, while the strengthening phase will more rapidly transform into stable δ and/or eta phases, with an accompanying loss of strength, in alloys having relatively low aluminum/titanium ratios.

Experimental alloy heats having the chemistries shown in Table 4 were prepared by VIM followed by VAR. Each alloy included, in weight percentages, nominally 25 iron, 12 chromium, 2.0 molybdenum, and 4.5 niobium. The VAR ingots were homogenized, press-forged and hot rolled into ⅝-inch round bars. Test sample blanks were cut from the rolled bars and treated by the following heat treatment conventionally applied to Alloy 718: hold at 1750° F. (954° C.) for 1 hour time-at-temperature; air cool; hold at 1325° F. (718° C.) for 8 hours time-at-temperature; furnace cool at 100° F./hr (27.7° C./hr) to 1150° F.; hold at 1150° F. (621° C.) for 8 hours time-at-temperature; and air cool. Each of the alloys in Table 4 had a combined aluminum+titanium level of about 3.3 atomic percent (about 1.8 to 3.2 weight percent, depending on alloy chemistry) to better ensure that the strengthening phase in each alloy was γ' phase. Iron and chromium contents for each of the alloys also were held in the above-discussed preferred ranges (iron≦30 weight percent; iron+chromium≦44 weight percent), and the alloys' niobium contents were held at about 4.5 weight percent to better ensure strength comparable to commercially available die casting die steels. The results of tensile and Charoy impact toughness testing are listed in Table 5 and illustrated in FIG. 4.

TABLE 4

| | Chemistry (weight percentages) | | | | | | | | | | | | | | | |
|---|---|---|---|---|---|---|---|---|---|---|---|---|---|---|---|---|
| Heat | C | Cr | Mo | W | Ni | Co | Fe | Nb | Al | Ti | P | B | Mn | Si | Ta | S |
| WP27-1 | 0.011 | 12.00 | 2.00 | <.01 | Bal. | 0.10 | 24.64 | 4.53 | 1.22 | 0.59 | <.003 | 0.004 | <.01 | <.01 | <.01 | <.0003 |
| WM46 | 0.006 | 11.92 | 2.01 | <.01 | Bal. | <.01 | 24.71 | 4.44 | 1.01 | 0.99 | <.003 | 0.004 | <.01 | <.01 | <.01 | <.0004 |
| WM45 | 0.006 | 11.93 | 2.01 | <.01 | Bal. | <.01 | 24.82 | 4.46 | 0.59 | 1.67 | <.003 | 0.004 | <.01 | <.01 | <.01 | <.0004 |
| WL37 | 0.008 | 11.90 | 2.01 | <.01 | Bal. | <.01 | 24.89 | 4.41 | 0.30 | 2.87 | <.003 | 0.004 | <.01 | <.01 | <.01 | <.0004 |

TABLE 5

| | Chemistry | | | | RT Tensile | | | | 1000° F. Tensile | | | | |
|---|---|---|---|---|---|---|---|---|---|---|---|---|---|
| | Al/Ti | | Al + Ti | | UTS | YS | | | UTS | YS | | | Charpy |
| Heat No. | wt % | at % | wt % | at % | ksi | ksi | EL % | RA % | ksi | ksi | EL % | RA % | Ft-lbs |
| WP27-1 | 2.07 | 3.67 | 1.81 | 3.31 | 206.2 | 129.6 | 26.0 | 52.5 | 175.1 | 119.2 | 24.0 | 51.2 | 91 |
| WM46 | 1.01 | 1.79 | 1.99 | 3.32 | 221.4 | 154.0 | 24.1 | 41.6 | 197.9 | 145.0 | 21.4 | 42.0 | 61.5 |
| WM45 | 0.35 | 0.62 | 2.28 | 3.31 | 222.1 | 170.4 | 22.4 | 34.4 | 195.1 | 147.9 | 23.9 | 53.1 | 12.5 |
| WL37 | 0.10 | 0.17 | 3.17 | 3.64 | 205.1 | 143.5 | 8.9 | 7.5 | 181.3 | 126.1 | 24.1 | 58.9 | 4 |

Figure 4:
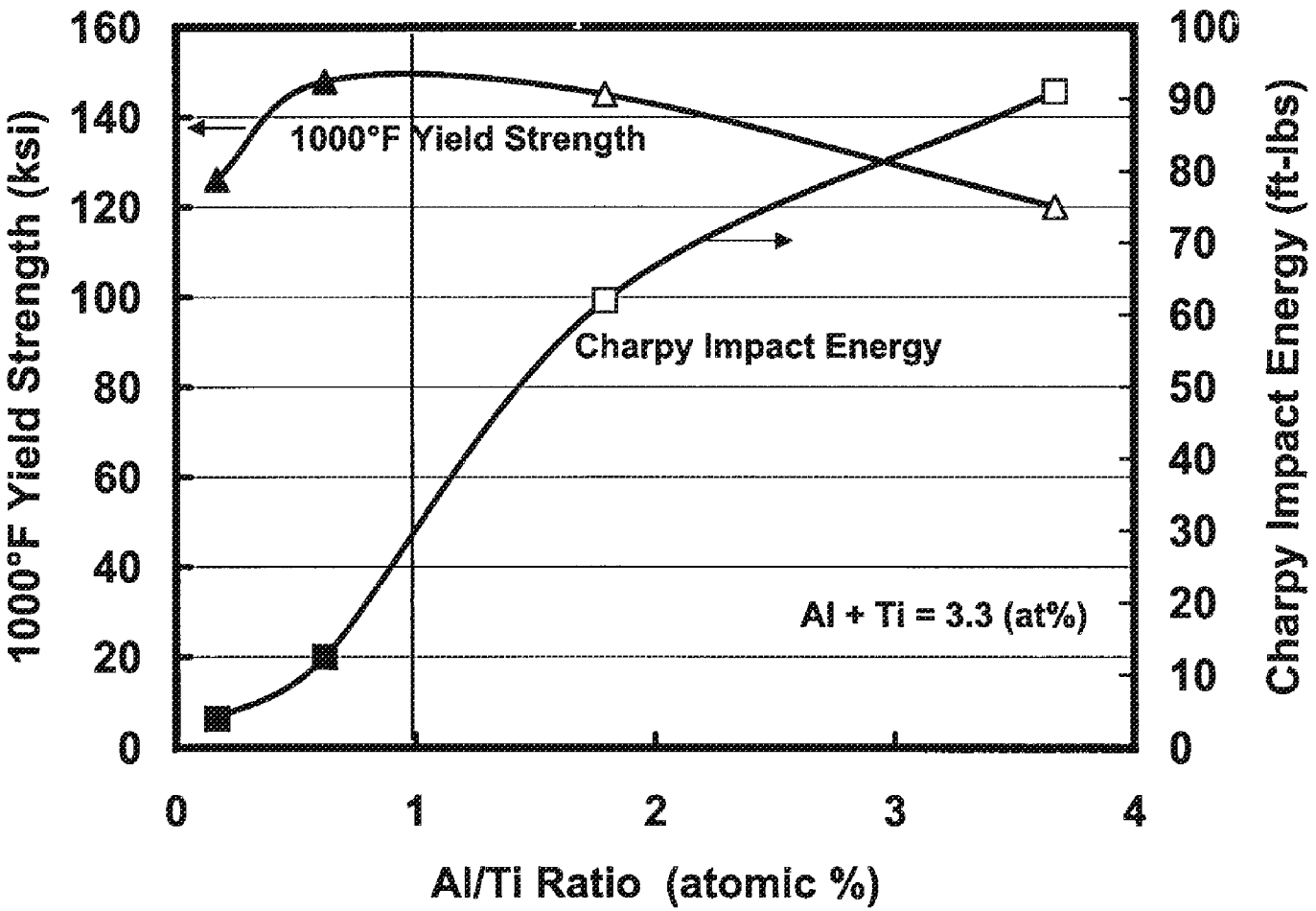
FIG. 4 is a plot illustrating mechanical properties of certain alloys according to the present disclosure as a function of aluminum/titanium atomic ratio, wherein solid symbols identify alloys containing a significant concentration of undesirable eta phase particles and open symbols identify alloys lacking noticeable eta phase particles.

It can be seen from Table 5 and FIG. 4 that alloy tensile strength changes slightly with increasing aluminum/titanium ratio, with peak strength reached at an aluminum/titanium atomic percentage ratio of about 1.0 (about 0.55 weight percentage ratio). Charpy impact energy was observed to increase dramatically with increasing aluminum/titanium ratio. For example, at a aluminum/titanium ratio of less than about 1.0 (based on atomic percentages) (closed symbols), Charpy impact energy levels were comparable to those of commercially available hot work die casting die steels. Above the 1.0 atomic ratio, however, the measured Charpy impact energies for the experimental alloys (open symbols) considered were approximately six to ten times that of conventional hot work die steels. Thus, it was observed that Charpy toughness rapidly increased with increasing aluminum/titanium ratios when the ratio is higher than 1.0 (based on atomic percentages).

Figure 5:
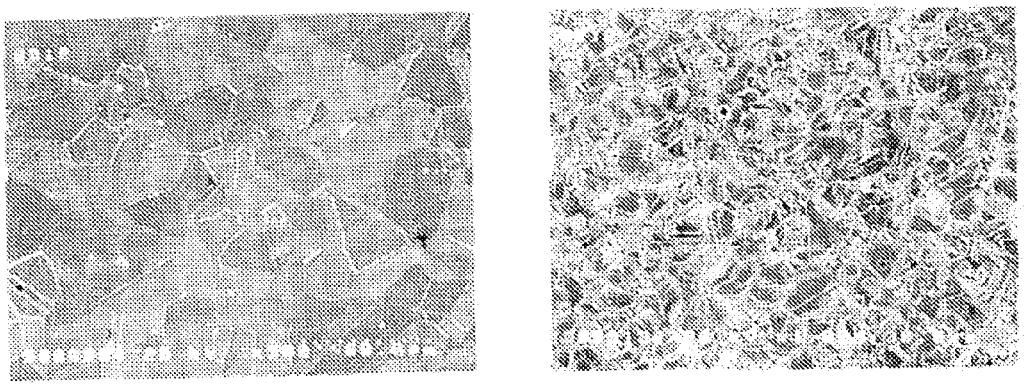
FIG. 5(*a*) is a photomicrograph of the microstructure of an alloy according to the present disclosure having a relatively high aluminum/titanium atomic ratio and lacking noticeable eta phase particles.

A microstructural study revealed that a significant content of needle-shaped eta phase particles was present in alloys with aluminum/titanium ratios less than 1.0 (based on atomic percentages). An example of the microstructure of one such experimental alloy having an aluminum/titanium ratio less than 1.0 (atomic percentages) is shown in FIG. 5(*b*) and includes heavy eta phase precipitation. FIG. 5(*a*), in contrast, depicts the microstructure of an experimental alloy having an aluminum/titanium ratio higher than 1.0 (atomic percentages), wherein no significant eta phase precipitation is evident. It appears that significant eta phase precipitation may be a cause or contributing factor in lower toughness in the experimental alloys.

Figure 6:
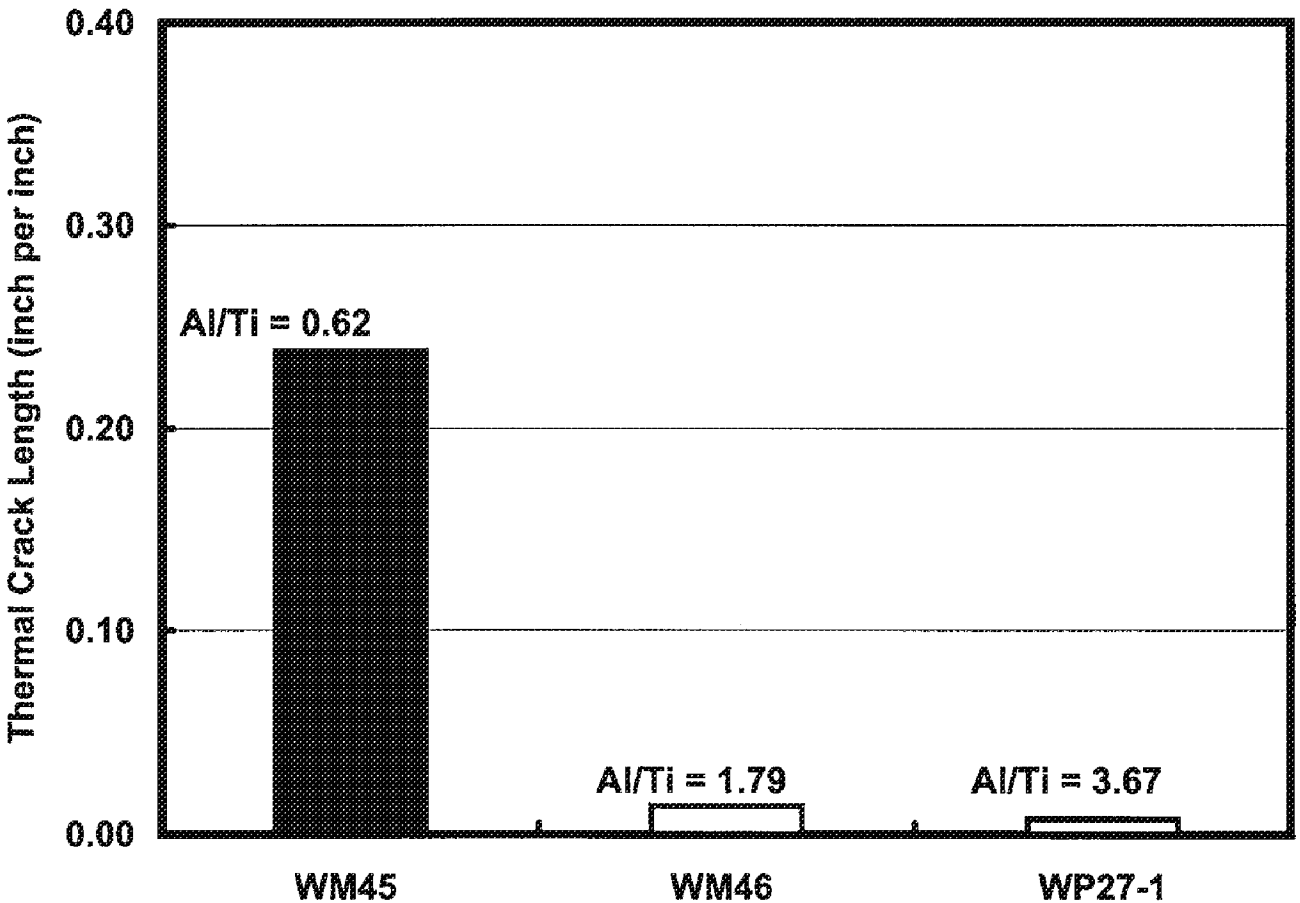
FIG. 6 is a plot illustrating the effect of aluminum/titanium atomic ratio on thermal fatigue cracking resistance for certain alloys according to the present disclosure (including combined aluminum+titanium levels of 3.3 to 3.6 weight percent), wherein solid bars identify alloys containing a significant concentration of eta phase particles and open bars identify alloys lacking noticeable eta phase particles.

A positive correlation between the presence of needle-shaped eta phase particle precipitation and thermal fatigue resistance also was observed. The thermal fatigue resistance results plotted in FIG. 6, assessed as described above (20,000 cycles assessment), indicate that experimental alloys having a significant level of needle-shaped eta phase particles (solid bar) had relatively low thermal fatigue cracking resistance (as reflected by thermal crack length per unit length) relative to those alloys lacking a significant level of such particles (open bars). This observation tends to confirm that a beneficial effect is derived from a relatively high aluminum/titanium ratio in alloys according to the present disclosure. The inventors concluded that improved thermal fatigue and Charpy toughness properties will be obtained in alloys according to the present disclosure having an aluminum/titanium ratio greater than 1.0 (based on atomic percentages). More preferably, alloys according to the present disclosure will have an aluminum/titanium ratio that is greater than 2.0 (based on atomic percentages). In terms of weight, to optimize thermal fatigue and toughness characteristics, the present inventors conclude that certain embodiments of the alloys according to the present disclosure will preferably include aluminum and titanium in an aluminum/titanium weight percentage ratio that is greater than 1.0, more preferably is in the range of 1.5 to 3 (inclusive), and even more preferably is greater than 2.0.

Figure 7:
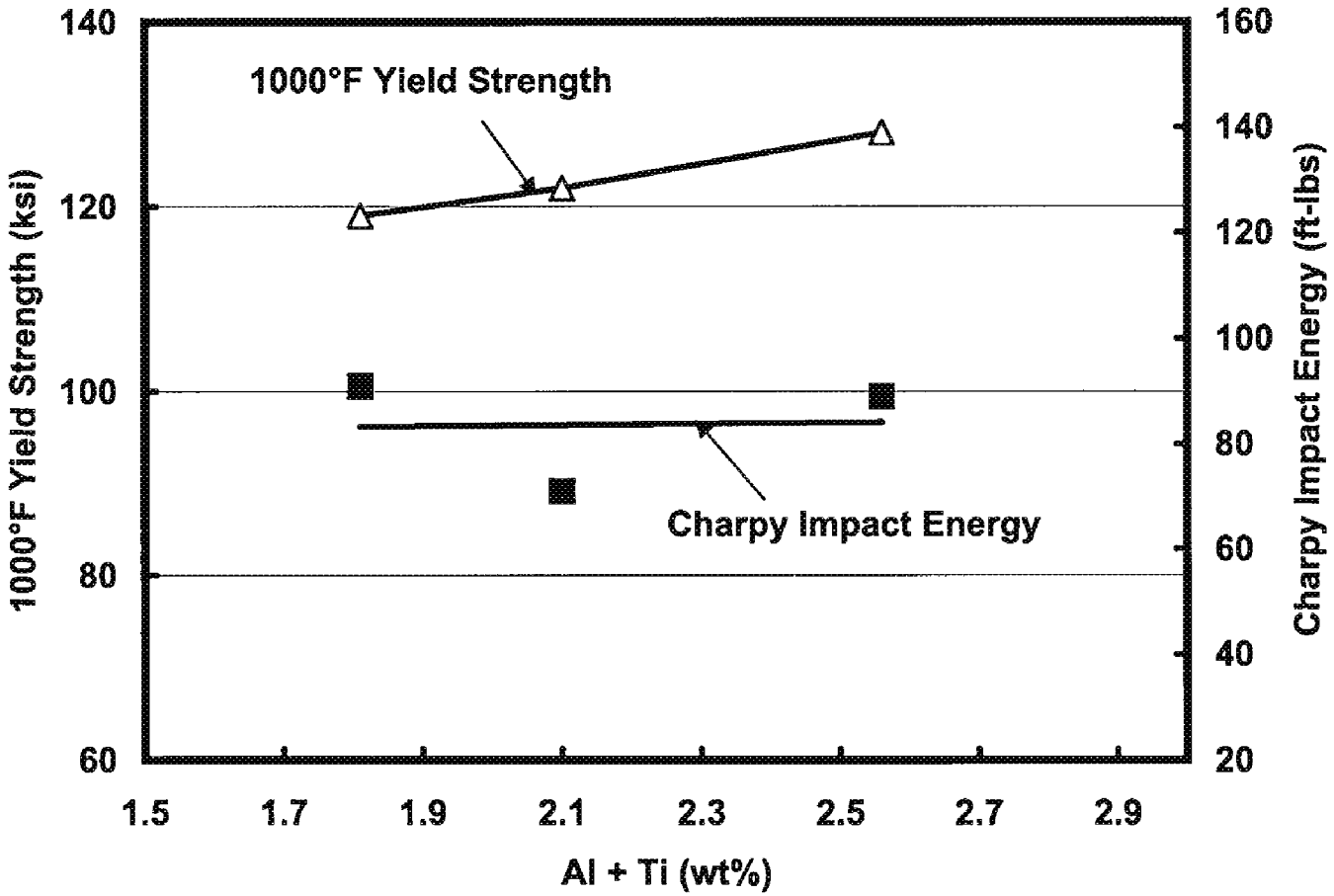
FIG. 7 is a plot of mechanical properties of certain alloys according to the present disclosure as a function of combined aluminum+titanium concentration (plotted in weight percentages)

The inventors also considered the effect of combined aluminum and titanium levels in experimental alloys having an aluminum/titanium ratio of about 3.3 (based on atomic percentages). Each alloy included, in weight percentages, nominally 25 iron, 12 chromium, 2.0 molybdenum, and 4.5 niobium, and each alloy was subjected to the following heat treatment steps before testing: hold at 1750° F. (954° C.) for 1 hour time-at-temperature; air cool; hold at 1325° F. (718° C.) for 8 hours time-at-temperature; furnace cool at 100° F./hr (27.7° C./hr) to 1150° F.; hold at 1150° F. (621° C.) for 8 hours time-at-temperature; and air cool. The specific chemistries of the experimental alloys considered are listed in Table 6, and certain measured mechanical properties of those alloys, determined subsequent to the foregoing heat treatment, are provided in Table 7. As FIG. 7 suggests, the yield strength of the alloys increased slightly with increasing aluminum+titanium level. The inventors believe that this effect was due to increased hardening γ' content. However, there appeared to be no clear trend in Charpy impact energy toughness with increased aluminum+titanium levels.

Figure 8:
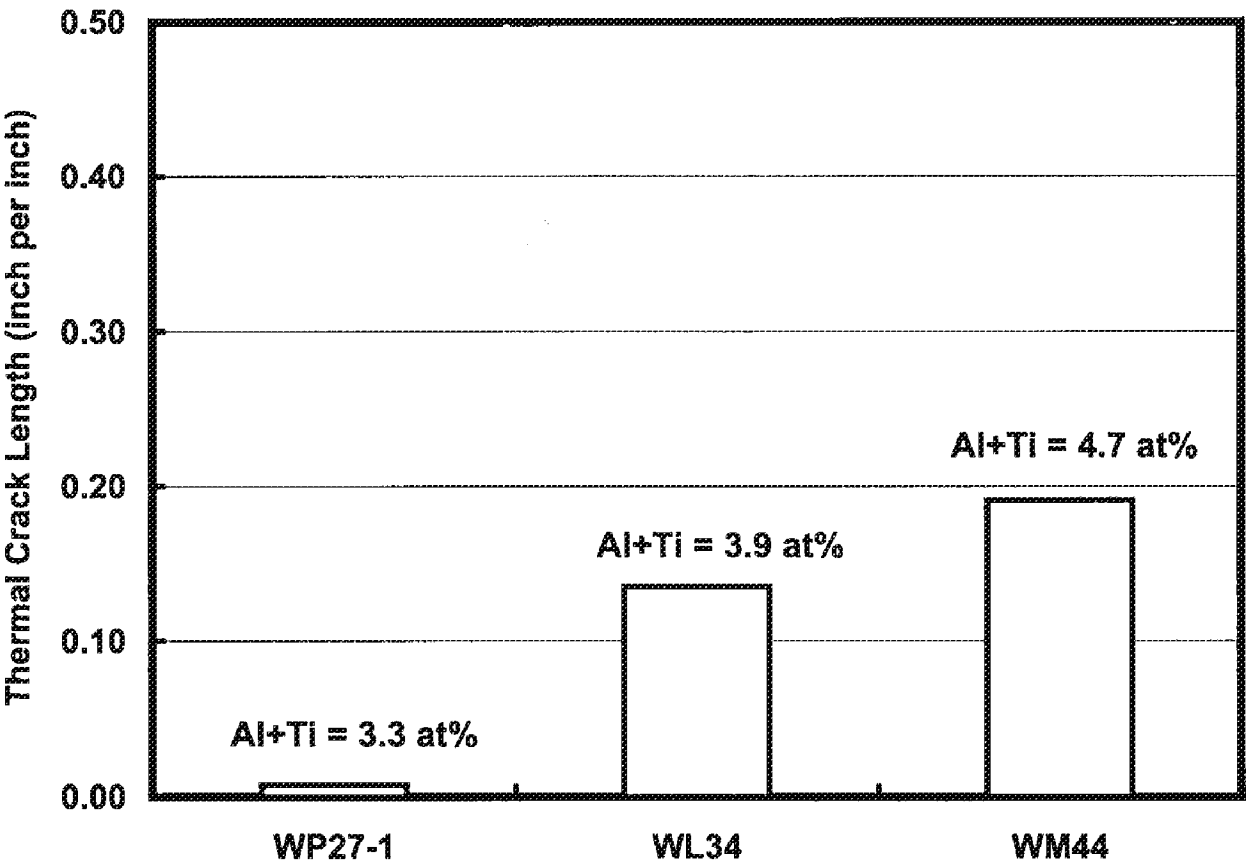
FIG. 8 is a plot of thermal fatigue cracking resistance of certain alloys according to the present disclosure having varying combined aluminum+titanium atomic concentrations.

FIG. 8 plots thermal crack length for the three experimental alloys after being subjected to the above-described thermal cycling testing, cycling between about 1300° F. (704° C.) and room temperature (68° F./20° C.), for 20,000 cycles. As illustrated by FIG. 8, the thermal fatigue cracking resistance was only slightly reduced with increasing aluminum+titanium content. In general, increased aluminum+titanium levels were observed to have a relatively minor effect on yield strength (assessed at about 100° F. (537° C.)) and thermal fatigue resistance, and good mechanical properties were achieved over the entire tested range of 1.8 to 2.6 weight percent combined aluminum+titanium levels.

TABLE 6

| Heat | Chemistry (weight percent) | | | | | | | | | | | | | | | |
|---|---|---|---|---|---|---|---|---|---|---|---|---|---|---|---|---|
| No. | C | Cr | Mo | W | Ni | Co | Fe | Nb | Al | Ti | P | B | Mn | Si | Ta | S |
| WP27-1 | 0.011 | 12.00 | 2.00 | <.01 | Bal. | 0.10 | 24.64 | 4.53 | 1.22 | 0.59 | <.003 | 0.004 | <.01 | <.01 | <.01 | <.0003 |
| WL34 | 0.012 | 12.07 | 2.02 | <.01 | Bal. | 0.11 | 25.57 | 4.46 | 1.45 | 0.68 | <.003 | 0.004 | <.01 | <.01 | <.01 | <.0003 |
| WM44 | 0.004 | 11.93 | 2.00 | <.01 | Bal. | <.01 | 24.68 | 4.48 | 1.78 | 0.79 | <.003 | 0.004 | <.01 | <.01 | <.01 | <.0003 |

TABLE 7

| | Chemistry | | | | RT Tensile | | | | 1000° F. Tensile | | | | |
|---|---|---|---|---|---|---|---|---|---|---|---|---|---|
| | Al + Ti | | Al/Ti | | UTS | YS | | | UTS | YS | | | Charpy |
| Heat No. | wt % | at % | wt % | at % | ksi | ksi | EL % | RA % | ksi | ksi | EL % | RA % | Ft-lbs |
| WP27-1 | 1.81 | 3.31 | 2.07 | 3.67 | 206.2 | 129.6 | 26.0 | 52.5 | 175.1 | 119.2 | 24.0 | 51.2 | 91 |
| WL34 | 2.10 | 3.90 | 2.23 | 3.78 | 202.5 | 136.8 | 29.0 | 54.7 | 173.5 | 121.4 | 27.2 | 56.2 | 71 |
| WM44 | 2.56 | 4.69 | 2.24 | 3.97 | 207.5 | 146.3 | 29.2 | 55.5 | 173.5 | 128.2 | 27.0 | 56.0 | 8 |

Given the foregoing observations and results related to the various experimental alloys discussed above, and in light of the properties considered important for the performance of die casting die alloys, nickel-base alloys according to the present disclosure preferably comprise, in weight percentages based on total alloy weight: 9 to 20 chromium; 25 to 35 iron; 1 to 3 molybdenum; 3.0 to 5.5 niobium; 0.2 to 2.0 aluminum; 0.3 to 3.0 titanium; less than 0.10 carbon; no more than 0.01 boron; nickel; and incidental impurities. In certain more preferred embodiments, the combined level of chromium and iron is less than or equal to 44 weight percent. Also, in certain preferred embodiments, the alloy includes no more than 30 weight percent iron. In certain preferred embodiments, the alloy combined level of aluminum and titanium is at least 1.0 weight percent, and more preferably is greater than 3.0 atomic percent. In addition, in certain preferred embodiments the aluminum/titanium ratio of the alloy, based on weight percentages, is greater than 1.0, more preferably is in the range of 1.5 to 3 (inclusive), and even more preferably is greater than 2.0.

Figure 9:
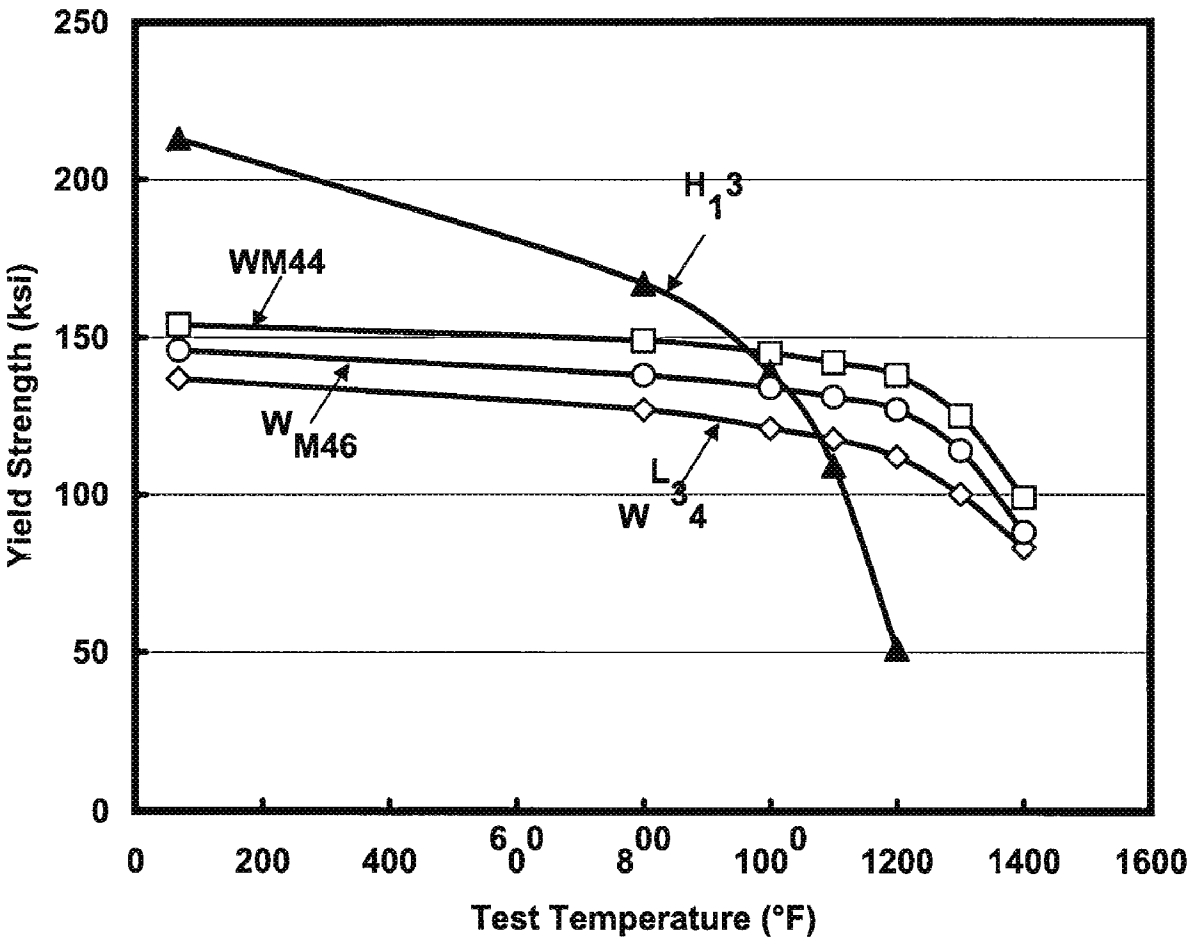
FIG. 9 is a plot illustrating the temperature dependence of the yield strength of certain alloys according to the present disclosure and H13 die steel alloy.
Figure 10:
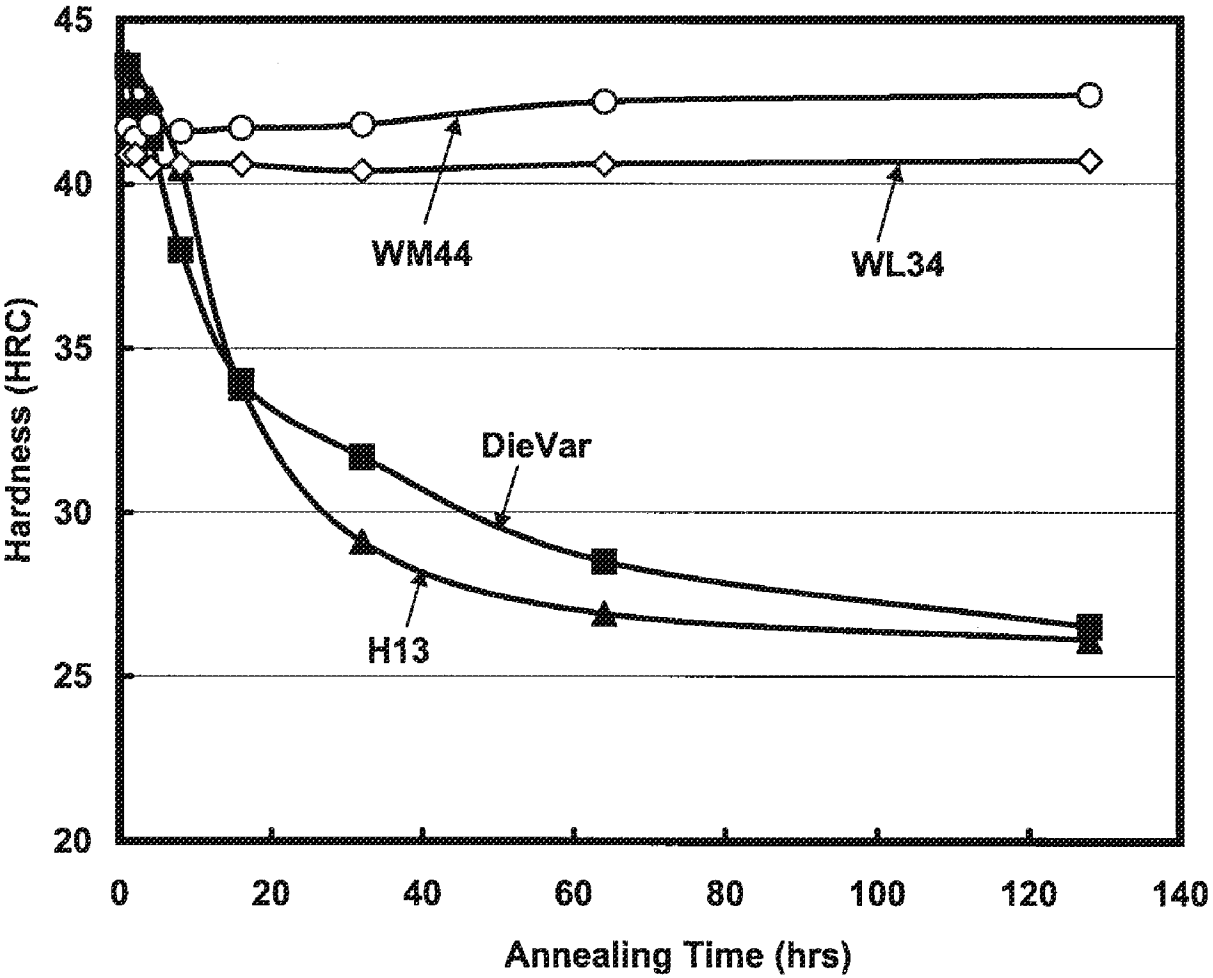
FIG. 10 is a plot of $HR_c$ hardness as a function of annealing time for certain alloys according to the present disclosure, H13 die steel alloy, and DIEVAR™ alloy.

Certain non-limiting alloy embodiments according to the present disclosure exhibit advantageous properties in comparison with, for example, the widely-used commercial die steel alloys H13 (UNS T20813) and a modified form of H13 alloy sold under the name DIEVAR™ alloy, available from Uddeholm Edelstahl. FIG. 9 plots yield strength as a function of test temperature for several experimental alloys and H13 alloy. FIG. 9 shows that the experimental alloys exhibited higher yield strength at normal die working temperatures (about 1100° F. (593° C.) and above), although the room temperature strength of the experimental alloys was lower than that of H13 alloy. Perhaps more significantly, the three tested experimental alloys exhibited significantly higher thermal stability than the H13 and DIEVAR alloys. This is clearly shown in FIG. 10, which plots the hardness ($HR_c$) of two of the experimental alloys and the H13 and DIEVAR alloys as a function of annealing time at an annealing temperature of about 1150° F. (621° C.). FIG. 10 shows that the H13 and DIEVAR alloys would rapidly lose hardness during the high-temperature die-casting operation, but the hardness of the experimental alloys does not significantly change. The excessive softening of conventional H13 and DIEVAR alloys when subjected to high temperature would significantly increase the driving force for thermal fatigue cracking, leading to shorter die life.

Figure 11:
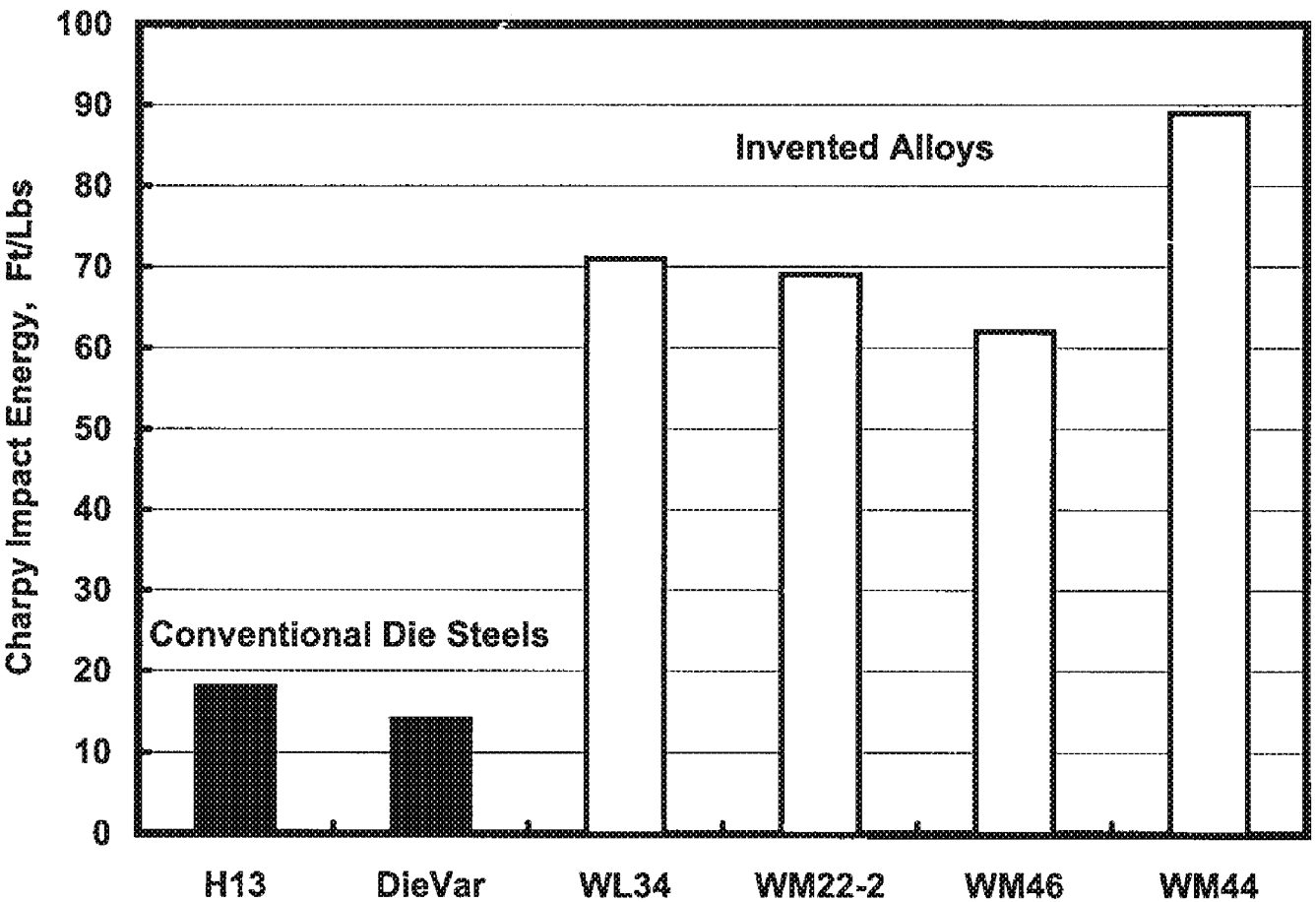
FIG. 11 is a plot of Charpy impact toughness, assessed at 68° F. (20° C.), for certain alloys according to the present disclosure, H13 die steel alloy, and DIEVAR™ alloy.

Certain embodiments of experimental alloys according to the present disclosure also exhibited significantly higher toughness than the H13 and DIEVAR alloys. As shown in FIG. 11, the Charpy impact energy (measured at 68° F. (20° C.)) of certain embodiments of experimental alloys according the present disclosure was in the range of 60-90 ft/lbs, which was approximately four times higher than toughness of the H13 and DIEVAR die steel alloys. High toughness is beneficial in that it helps to prevent catastrophic failure of casting dies, but also because it increases resistance of the alloys to thermal fatigue cracking.

Figure 12:
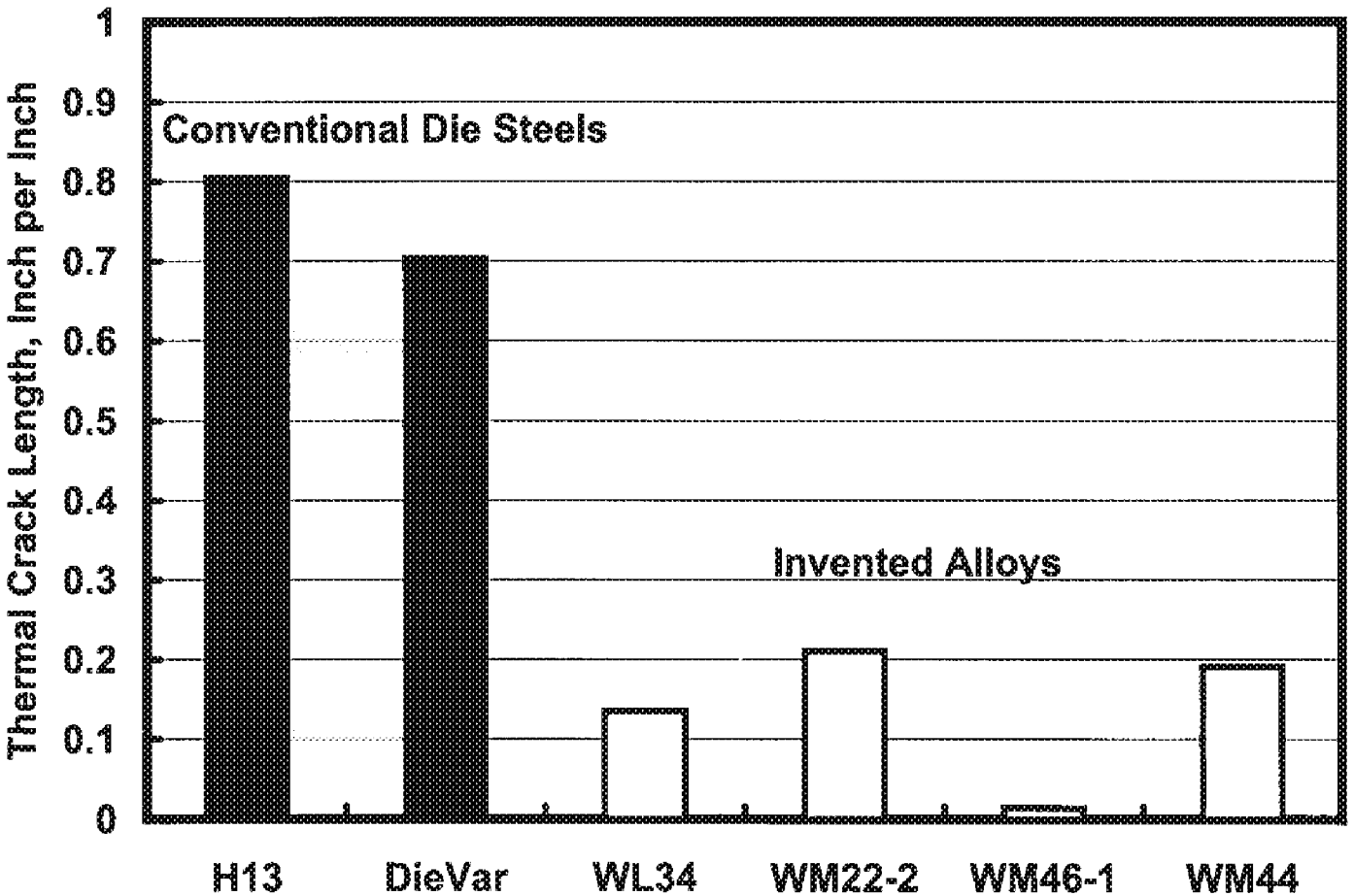
FIG. 12 is a plot of thermal fatigue cracking resistance for certain alloys according to the present disclosure, H13 die steel alloy, and DIEVAR™ alloy.

As discussed above, corrosion and stress corrosion cracking (SCC) can play a significant role in the incidence of thermal fatigue cracking in die casting die materials. Nickel-chromium base alloys typically exhibit much higher corrosion resistance than martensitic iron-base alloys. Also, the face-centered cubic (fcc) crystal structures of nickel-base alloys typically exhibit higher SCC resistance relative to normal martensitic iron-base die steels, which commonly have a body-centered cubic (bcc) crystal structure. It is believed that the combined high strength, high thermal stability, high toughness, and high corrosion and SCC resistance of experimental alloys described herein will provide high thermal fatigue cracking resistance. FIG. 12 shows the thermal fatigue cracking resistance, measured as described above (20,000 heat/cool cycles), for certain alloys according to the present disclosure and for conventional H13 and DIEVAR die steel alloys. FIG. 12 clearly shows the excellent thermal fatigue cracking resistance of the experimental alloys relative to the conventional die steel alloys.

Another advantage of embodiments of the experimental alloys is that they may be heat treated in a simple fashion relative to that used for certain conventional die steels. The simple solution-age treatment described herein used with certain alloys according the present disclosure, which can be conducted in air, should be less costly and easier to control relative to the complex multiple-step, vacuum tempering treatment applied to certain conventional die steels.

The present inventors also have compared experimental alloys according to the present disclosure with the existing nickel-base Alloy 718 (UNS N07718). The cost of the alloys according to the present disclosure should be less than that of Alloy 718 given the lower content of expensive alloying elements, such as niobium, molybdenum, and nickel. The measured toughness of certain of the experimental alloys according to the present disclosure also is much higher than Alloy 718, which has toughness similar to conventional die steels. Also, the machinability of the alloys according to the present disclosure is significantly better than that of Alloy 718. A primary machinability test was run comparing the life of tools during machining of Alloy 718 and the alloy of Heat WL34. Both alloys were tested in an identical solution treated condition. The tool life time for machining the WL34 alloy was approximately 50% greater than that for machining of Alloy 718 at identical machining conditions (using a face mill at a 35 m/min cutting speed and 0.1 mm feed). Severe edge chipping of the cutting tool was observed during machining of Alloy 718, while no chipped edges were observed during machining of the experimental alloy.

As discussed above, the properties of various tested embodiments of nickel-base alloys according to the present disclosure show that the alloys are suitable for die casting die applications. Those having ordinary skill in the art may readily fabricate die casting dies from alloys according to the present disclosure. As is well known to those of ordinary skill in the art, the process of fabricating die casting dies from nickel-base alloys generally involves the steps of melting and casting an ingot, forging to rough size, solution treating, die impression sinking and final aging. Also, given the properties of the alloys described herein, additional tooling and other articles of manufacture could be fabricated or comprise such alloys. Such tooling and articles include, for example, open and closed die forging dies, extrusion liners, punches and dies. Those persons having ordinary skill may readily fabricate such articles of manufacture from the alloys described herein without the need for additional description herein.

Although the foregoing description has necessarily presented only a limited number of embodiments, those of ordinary skill in the relevant art will appreciate that various changes in the alloys, articles, and methods and other details of the examples that have been described and illustrated herein may be made by those skilled in the art, and all such modifications will remain within the principle and scope of the present disclosure as expressed herein and in the appended claims. For example, although the present disclosure has necessarily only presented a limited number of embodiments according to the present disclosure, it will be understood that the present disclosure and associated claims are not so limited. Those having ordinary skill will readily identify additional alloys, articles, and methods within the spirit of the necessarily limited number of embodiments discussed herein. It is understood, therefore, that the present invention is not limited to the particular embodiments disclosed or incorporated herein, but is intended to cover modifications that are within the principle and scope of the invention, as defined by the claims. It will also be appreciated by those skilled in the art that changes could be made to the embodiments above without departing from the broad inventive concept thereof.

We claim:

1. An article of manufacture comprising a nickel-base alloy having favorable toughness and thermal fatigue resistance, the alloy comprising, in weight percentages based on total alloy weight: 9 to 12 chromium; 25 to 35 iron; 1 to 2.5 molybdenum; 3.0 to 5.5 niobium; 1.0 to 2.0 aluminum; 0.3 to 3.0 titanium; less than 0.10 carbon; no more than 0.01 boron; nickel; and incidental impurities, wherein the article of manufacture is selected from the group consisting of a die casting die, a die forging die, an extrusion liner, a punch, and a die.

2. The article of manufacture of claim 1, wherein the article of manufacture is a die casting die.

3. The article of manufacture of claim 2, wherein the nickel-base alloy comprises 9 to 12 weight percent chromium; 25 to 30 weight percent iron; 1 to 2.5 weight percent molybdenum; 3.0 to 5.5 weight percent niobium; 1.0 to 2.0 weight percent aluminum; 0.3 to 3.0 weight percent titanium; less than 0.10 weight percent carbon; no more than 0.01 weight percent boron; nickel; and incidental impurities; wherein the combined weight percentage of chromium and iron is no greater than 44, the combined concentration of aluminum and titanium is greater than 3.0 atomic percent, and the aluminum/titanium ratio of the alloy, based on weight percentages, is greater than 1.0.

4. The article of manufacture of claim 1, wherein the combined weight percentage of chromium and iron is no greater than 44.

5. The article of manufacture of claim 1, wherein the alloy comprises no greater than 30 weight percent iron.

6. The article of manufacture of claim 1, wherein the combined weight percentage of aluminum and titanium is at least 1.0 weight percent.

7. The article of manufacture of claim 1, wherein the combined weight percentage of aluminum and titanium is greater than 3.0 atomic percent.

8. The article of manufacture of claim 1, wherein the aluminum/titanium ratio of the alloy, based on weight percentages, is greater than 1.0.

9. The article of manufacture of claim 1, wherein the aluminum/titanium ratio of the alloy, based on weight percentages, is 1.5 to 3.

10. The article of manufacture of claim 1, wherein the aluminum/titanium ratio of the alloy, based on weight percentages, is greater than 2.0.

11. The article of manufacture of claim 1, wherein the alloy comprises 1.5 to 2.5 weight percent molybdenum.

12. The article of manufacture of claim 1, wherein the alloy comprises 4.0 to 5.0 weight percent niobium.

13. The article of manufacture of claim 1, wherein the alloy comprises 1.0 to 1.8 weight percent aluminum.

14. The article of manufacture of claim 1, wherein the alloy comprises 0.4 to 1.0 weight percent titanium.

15. The article of manufacture of claim 1, wherein the alloy comprises 0.3 to 0.79 weight percent titanium.

16. The article of manufacture of claim 1, wherein the alloy comprises no more than 0.005 weight percent boron.

17. The article of manufacture of claim 1, wherein the alloy comprises, in weight percentages based on total alloy weight: 9 to 12 chromium; 25 to 30 iron; 1.5 to 2.5 molybdenum; 4 to 5 niobium; 1.0 to 1.8 aluminum; 0.4 to 1.0 titanium; less than 0.10 carbon; no more than 0.005 boron; nickel; and incidental impurities.

18. The article of manufacture of claim 16, wherein the combined weight percentage of chromium and iron is no greater than 44.

19. The article of manufacture of claim 16, wherein the combined concentration of aluminum and titanium is at least 1.0 weight percent.

20. The article of manufacture of claim 16, wherein the aluminum/titanium ratio of the alloy, based on weight percentages, is greater than 1.0.

21. The article of manufacture of claim 1, wherein the alloy consists essentially of, in weight percentages based on total alloy weight: 9 to 12 chromium; 25 to 35 iron; 1 to 2.5 molybdenum; 3.0 to 5.5 niobium; 1.0 to 2.0 aluminum; 0.3 to 3.0 titanium; less than 0.10 carbon; no more than 0.10 boron; optionally, trace elements; incidental impurities; and nickel.

22. The article of manufacture of claim 1, wherein the alloy consists of, in weight percentages based on total alloy weight: 9 to 12 chromium; 25 to 35 iron; 1 to 2.5 molybdenum; 3.0 to 5.5 niobium; 1.0 to 2.0 aluminum; 0.3 to 3.0 titanium; less than 0.10 carbon; no more than 0.10 boron; optionally, trace elements; incidental impurities; and balance nickel.

23. An article of manufacture comprising a nickel-base alloy having favorable toughness and thermal fatigue resistance, the alloy comprising, in weight percentages based on total alloy weight: 9 to 12 weight percent chromium; 25 to 30 weight percent iron; 1 to 2.5 weight percent molybdenum; 3.0 to 5.5 weight percent niobium; 1.0 to 2.0 weight percent aluminum; 0.3 to 3.0 weight percent titanium; less than 0.10 weight percent carbon; no more than 0.01 weight percent boron; nickel; and incidental impurities; wherein the combined weight percentage of chromium and iron is no greater than 44, the combined concentration of aluminum and titanium is greater than 3.0 atomic percent, and the aluminum/titanium ratio of the alloy, based on weight percentages, is greater than 1.0; and wherein the article of manufacture is selected from the group consisting of a die casting die, a die forging die, an extrusion liner, a punch, and a die.

24. The article of manufacture of claim 1, wherein the aluminum/titanium ratio of the alloy, based on weight percentages, is greater than 1.0 to 2.25, and wherein the alloy has a Charpy impact energy measured at 68° F. from 60 to 90 ft/lbs.

25. An article of manufacture comprising a nickel-base alloy having favorable toughness and thermal fatigue resistance, the alloy comprising, in weight percentages based on total alloy weight: 9 to 12 chromium; 25 to 35 iron; 1 to 2.5 molybdenum; 3.0 to 5.5 niobium; 1.0 to 2.0 aluminum; 0.3 to 0.99 titanium; less than 0.10 carbon; no more than 0.01 boron; nickel; and incidental impurities, wherein the aluminum/titanium ratio of the alloy, based on weight percentages, is greater than 1.0 to 2.25, and the wherein the article of manufacture is selected from the group consisting of a die casting die, a die forging die, an extrusion liner, a punch, and a die.

* * * * *